US007533510B2

(12) United States Patent
Sytema

(10) Patent No.: US 7,533,510 B2
(45) Date of Patent: May 19, 2009

(54) COMPACT INSERTER

(75) Inventor: Herman Sytema, Terhorne (NL)

(73) Assignee: NEOPOST Technologies, Bagneux (FR)

( * ) Notice: Subject to any disclaimer, the term of this patent is extended or adjusted under 35 U.S.C. 154(b) by 0 days.

(21) Appl. No.: 11/320,151

(22) Filed: Dec. 28, 2005

(65) Prior Publication Data

US 2006/0145407 A1 Jul. 6, 2006

(30) Foreign Application Priority Data

Dec. 31, 2004 (NL) ..... 1027937

(51) Int. Cl.
*B65B 63/04* (2006.01)

(52) U.S. Cl. ..... 53/117; 53/381.7; 53/569; 270/58.06

(58) Field of Classification Search ..... 53/381.7, 53/569, 117
See application file for complete search history.

(56) References Cited

U.S. PATENT DOCUMENTS

| | | | | | |
|---|---|---|---|---|---|
| 2,728,178 | A | | 12/1955 | Kern | 53/136 |
| 3,797,196 | A | * | 3/1974 | Harbison | 53/55 |
| 4,619,101 | A | * | 10/1986 | Havey et al. | 53/117 |
| 4,924,652 | A | | 5/1990 | Krasuski et al. | 53/55 |
| 5,147,275 | A | * | 9/1992 | Staniszewski | 493/416 |
| 5,269,744 | A | * | 12/1993 | Moll | 493/421 |
| 5,410,860 | A | * | 5/1995 | Coudray et al. | 53/569 |
| 5,514,066 | A | * | 5/1996 | Monaco | 493/25 |
| 5,674,348 | A | * | 10/1997 | DeFiguerido | 156/441.5 |
| 6,689,040 | B2 | * | 2/2004 | Ifkovits et al. | 493/419 |

FOREIGN PATENT DOCUMENTS

| | | |
|---|---|---|
| CH | 267 710 | 1/1948 |
| DE | 1 461 690 | 1/1969 |
| EP | 1 297 969 | 4/2003 |

* cited by examiner

*Primary Examiner*—Thanh K Truong
(74) *Attorney, Agent, or Firm*—Sughrue Mion, PLLC

(57) ABSTRACT

Inserter with a folding assembly for folding documents, an envelope holder for each time holding an envelope in a stuffing position in or against a surface, a document transport path for transporting documents from the folding assembly, around one of the folding rollers to the stuffing position, and a flap hold-open element on a first side of the document transport path for holding open a flap of an envelope held in the envelope holder. A most downstream guide of the document transport path on the first side of the document transport path is situated opposite one of the folding rollers for guiding documents between that folding roller and that guide, so that documents are driven to the stuffing position by said one of the folding rollers (8).

4 Claims, 1 Drawing Sheet

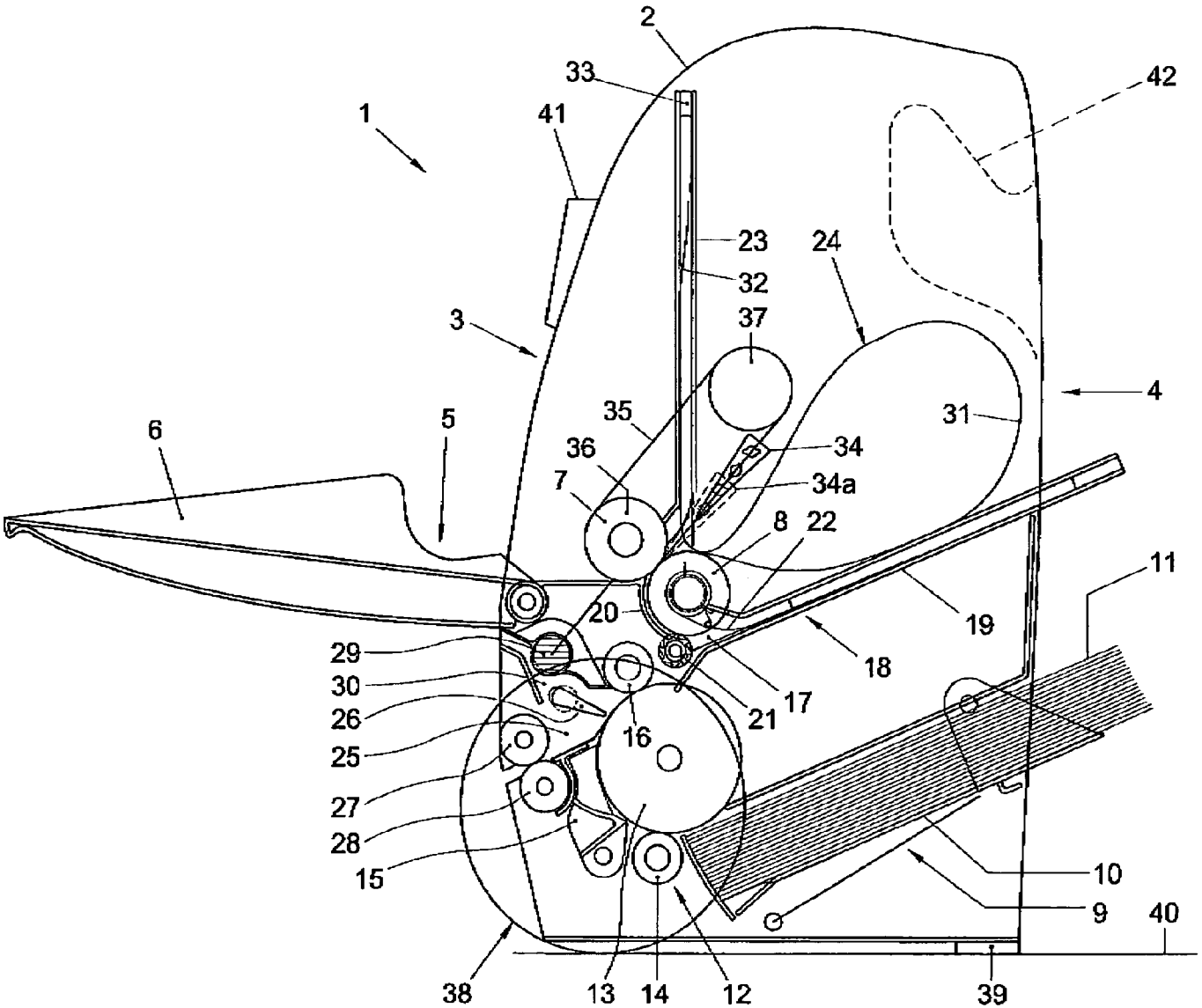
42
4
11
40
10
9
39
31
19
18
24
34
34a
22
8
17
21
23
32
37
12
2
14
16
13
33
35
36
20
7
41
3
5
38
1
29
30
26
25
27
28
15
6

COMPACT INSERTER

CROSS-REFERENCE TO RELATED APPLICATIONS

This application claims priority from Dutch Patent Application No. NL 1027937, filed on Dec. 31, 2004.

FIELD AND BACKGROUND OF THE INVENTION

This invention relates to an inserter. Such apparatuses are known from practice and are typically used in mailrooms where large numbers of documents or sets of documents are each to be inserted in an envelope in order to send these documents to addressees.

However, also in small organizations that send relatively small numbers of documents, and where the documents to be sent are for a considerable part processed by hand also when being prepared prior to insertion, mechanized insertion could lead to considerable saving of labor. To be considered here are, for instance, medical practices, workshops and club administrations, as well as service companies taking care of sending smaller mailings for third parties. Accordingly, there is a need for inserters that are compact enough and simple enough to be attractive in cost price and complexity of operation for applications on a smaller scale than existing inserters.

SUMMARY OF THE INVENTION

It is an object of the invention to provide a solution enabling a simpler and more compact structure of an inserter.

This object is achieved according to the invention by providing an inserter comprising:

a folding assembly having a pair of folding rollers for folding documents;

an envelope holder for each time holding an envelope in a stuffing position in or against a surface;

a document transport path for transporting documents from the folding assembly, around one of the folding rollers to the stuffing position; and a flap hold-open element on a first side of the document transport path for holding open a flap of an envelope held in the envelope holder;

wherein a most downstream guide of the document transport path on said first side of said document transport path is situated opposite one of the folding rollers for guiding documents between said folding roller and said guide, so that documents are driven to the stuffing position by said one of the folding rollers.

As a most downstream guide on the side of the document transport path operatively facing the flap of the envelope is situated opposite one of the folding rollers, the documents, upon transport from the nip between the folding rollers until their reaching the stuffing position, can be driven by one of the folding rollers and on the side of that folding roller no farther provisions for transporting the documents are necessary. Accordingly, for the transport of the documents from between the folding rollers to the stuffing position, a short transport path is obtained, which is advantageous for a compact structure, and drive by the folding roller can suffice, which is advantageous for the constructional simplicity.

Embodiments of the invention are laid down in the dependent claims. Further features, effects and details of the invention will be illustrated and elucidated on the basis of an exemplary embodiment with reference to the drawing.

BRIEF DESCRIPTION OF THE DRAWING

The drawing is a cutaway side elevational view of an example of an inserter according to the invention.

DETAILED DESCRIPTION

The inserter 1 according to the example represented in the drawing has a housing 2 with a front side 3 and a rear side 4.

On the front side 3 is a document feeder 5 with a document holder 6 for taking up a document (not shown) and with a dispenser formed by a pair of folding rollers 7, 8 for dispensing a document from the document holder 6. The document holder 6 at the same time forms a cover of the housing 2, adapted to be hinged between the open position represented and a closed position not represented.

On the rear side 4 is an envelope feeder 9 with an envelope holder 10 for taking up a stack of envelopes 11 and with a separator 12 for separately dispensing individual envelopes from the holder 10. According to this example, the separator 12 is equipped with a transport roller 13 for taking up envelopes and a separation roller 14 for each time stopping next envelopes, so that each time a single envelope can be dispensed off the top of the stack 11.

An envelope transport path between the envelope feeder 9 and a stuffing position serves for transporting envelopes 11 from the envelope feeder 9 to the stuffing position. The envelope transport path extends between on the one hand the transport roller 13 and on the other hand a guide 15 and a guide roller 16.

The guide 15, which also serves as scraper for opening the flap of the passing envelope, and the guide roller 16 guide the envelope during operation, so that it is held against the circumferential surface of the transport roller 13, until an inlet 17 of a stuffing assembly 18 is reached. When the envelope has arrived in the stuffing position, the guide roller 16 retains the flap of the envelope against the transport roller 13. The guide roller 16 thus forms at the same time a flap hold-open element.

The stuffing assembly 18 is equipped with a holder 19 for each time holding an envelope in the stuffing position and with guides 22 for each time guiding a document into an envelope in the stuffing position.

A document transport path for transporting documents from the document feeder 5 to the stuffing position extends from the document feeder 5 and has a branch passing between and through the folding rollers 7, 8 and terminating in a buckle chute 23. Laterally of the buckle chute 23 there is room to allow a document 24 to be folded to buckle into a loop.

The folding rollers 7, 8 extend throughout the width of the document transport path, so that they can form a fold extending throughout the width of the document 24.

A first section 31 of the document 24, measured from a folding nip between the folding rollers 7, 8 along the document 24, is located closer to the folding nip than is a second section 32. For causing the first section 31 of the document 24 to buckle into a loop, the folding rollers 7, 8 are drivable in an input rotation sense, and an arrester is provided in the form of a stop 33 in the buckle chute 23 for arresting a portion of the document 24 downstream of the folding rollers 7, 8 with respect to the portions of the document 24 transported between the folding rollers 7, 8.

Means for bending the second section 32 of the document 24 to the folding nip are formed, according to this example, by a folding blade 34 which is reciprocable between the positions designated with reference numerals 34 and 34*a*. To this end, the folding blade 34 is attached to a pair of toothed belts 35 which pass around rollers 36, 37 and which are coupled with the drive of the folding rollers 7, 8 via a clutch (not shown).

The folding rollers 7, 8 are further drivable in an output rotation sense, such that the second section 32 of the document 24 is transported into the folding nip.

In operation, the folding of a document 24 in the apparatus shown starts with introducing the document 24 into the folding nip between the folding rollers 7, 8. Next, to cause the first section 31 of the document 24 to buckle into a loop, the folding rollers 7, 8 are rotated further in the input rotation sense, whereby portions of the document 24 situated between the folding rollers 7, 8 are transported further. Relative to the portions of the document 24 transported between the folding rollers 7, 8, the portion 32 of the document 24 downstream of the folding rollers 7, 8 is arrested in that it butts against the stop 33 in the buckle chute 23.

Rotating the folding rollers 7, 8 is then continued, until the operative condition represented in the drawing has been reached, in which a trailing end portion of the document 24 is just, retained between the folding rollers 7, 8.

Next, the second section 32 of the document 24 is urged to the folding nip, in that the folding blade 34, on a side of the document 24 remote from the folding nip, is moved towards the folding nip, into the position designated with reference numeral 34*a*.

The folding rollers 7, 8 are then rotated in an output rotation sense, whereby the sections of the folding rollers 7, 8 in the area of the folding nip transport the second section 32 into the folding nip and a first fold is formed.

Next, the folding rollers 7, 8 rotate further, so that also the first section 31 of the document 24 is transported through the folding nip and a second fold, spaced from the first fold, is formed in that the loop is folded flat.

When the document 24 has been outputted, the folding blade 34 is moved back to its initial position. This can for instance be done during the input of a next document 24 to be folded.

Further, the document transport path proceeds between a lower one of the folding rollers 8 and guides 20, 21 in the form of a plate 20 and a roller 21 to the stuffing position, for transporting folded documents to the stuffing position.

As, on the side of the document transport path where also the flap hold-open element 16 is situated, the most downstream guide 21 of the document transport path is situated opposite one of the folding rollers 8, the documents, upon transport from the nip between the folding rollers 7, 8 until their reaching the stuffing position, can be driven by one of the folding rollers 8 and on the side of that folding roller 8 no further provisions for transporting the documents are needed. Accordingly, for the transport of the documents from between the folding rollers 7, 8 to the stuffing position, a short transport path is obtained, which is advantageous for a compact structure. Moreover, drive by the folding roller 8 can suffice, which is advantageous for constructional simplicity.

The most downstream guide 21 of the document transport path on the side of the document transport path where also the flap hold-open element 16 is situated, is designed as a transport roller which abuts against the one of the folding rollers 8 around which the document transport path proceeds. This guide 21, along with the folding roller 8 against which it rests, forms a nip for engagement of documents to be transported to the stuffing position. As a consequence, in operation, at that last guide, a thrust towards the stuffing position can be exerted on the documents. Thus, the documents are reliably pushed into the envelope present in the stuffing position.

The branch of a document transport path extending between the folding rollers 7, 8 and the envelope holder 19 bounding the stuffing position jointly define a V-shaped path, of which a bottom portion is bounded by a circumferential portion of one of the folding rollers 8. Such a folded-up configuration, which may also be U-shaped, of these two dead-end transport paths is advantageous for a compact structure of an inserter.

Together with the envelope feeder 9, these dead-end transport paths moreover form a W-shaped system of transport paths, of which one bottom portion is bounded by a circumferential portion of one of the folding rollers 8 and another bottom portion is bounded by a circumferential portion of the transport roller 18 of a separator 12 of the envelope feeder 9 for dispensing individual envelopes one by one. Such a configuration, in which the path portions for supplying and processing components into a mail item project like fingers, with each time only a roller between two successive ones of the fingers, further contributes to simplicity of construction and compact build.

A mail item output path 25 is connected with the stuffing position for transporting stuffed envelopes from the stuffing position and extends between the transport roller 13 and the guide roller 16, along a switch valve 26 for closing the flap and between a pair of output rollers 27, 28.

The output rollers 27, 28 also form an exit for delivering stuffed envelopes transported along the mail item output path 25. Along a side of the switch valve remote from the mail item output path 25 extends a branch 30 for guiding the flap of the envelope to a moistener 30. The switch valve 26 is arranged, each time upon the further transport of an envelope, after the flap thereof has been moistened by the moistener 30, to pivot along with the envelope from the position shown to a position directed more towards the output rollers 27, 28. The flap of the envelope is thereby closed. The output rollers 27, 28 also serve for pressing on the closed flap of the envelope.

That the document feeder 5 and the exit 27, 28 are situated at the front of the housing 2 provides the advantage that these are easily operable for a user operating the inserter 1 from a workplace. The document feeder 5 in which the user must each time place documents to be inserted is moreover well accessible because it is situated above the exit 27, 28.

That the envelope holder 10 is accessible exclusively from a rear side of the housing then provides the advantage that it does not occupy any space at the front, thus enabling a compact structure.

The housing 2 has feet 38, 39, 41 for supporting the housing 2 via these feet 38, 39, 41 on a supporting surface 40 on which the apparatus stands. According to this example, the feet 38, 39, 41 are positioned in pairs and of each pair of feet 38, 39, 41 one is visible in the side elevational view. The feet 38, 39, 41 are arranged for allowing rotation of the housing 2 between the operating position and a loading position while it rests via a set 38 of those feet 38, 39, 41 on the supporting surface 40, and for keeping the housing 2 supported in the two positions. The apparatus 1 in the operating position then rests by the feet 38, 39 on the supporting surface 40, while a set 41 of the feet are situated at the front of the housing 2. In the loading position, the apparatus rests by the feet 38, 41 on the supporting surface 40, while a set 39 of the feet are situated on a rear side of the housing 2.

In the loading position, the original rear side 4 of the housing 2 faces up, so that the envelope holder 10, which is accessible exclusively from the side 4 of the housing 2 that faces rearwards in the operating condition, is readily accessible to the user without him needing to leave his workplace.

To further facilitate the housing 2 being moved back and forth between the two positions mentioned, it is provided with a grip 42 adjacent its upper end. In the condition of use, this grip 42 is situated at the rear side and in the loading condition at the upper side of the housing 2, so that the grip can easily be held while changing the position of the housing without requiring to be regripped.

The invention claimed is:

1. An inserter for folding a document and inserting the folded document into an envelope, comprising:

a folding assembly having a pair of folding rollers defining a folding nip between the folding rollers, for folding the document;

an envelope holder for holding the envelope body in a stuffing position to allow insertion of the folded document into the envelope body held by the envelope holder; and a document transport path including a portion extending from said folding nip to the stuffing position for transporting the folded document from the folding nip, to the stuffing position, the portion of the document transport path extending from the folding nip to the stuffing position being formed between a section of one of the folding rollers and at least one guide of which at least a portion extends around said one of the folding rollers along said section of said one of the folding rollers for guiding a document in circumferential direction along said section of said one of the folding rollers between said guide and said section of said one of the folding rollers;

wherein, in downstream directions, said at least one guide ends in a position opposite said one of the folding rollers, for guiding the document in the circumferential direction along said section of said one of the folding rollers between said guide and said section of said one of the folding rollers until the position where said guide ends.

2. An inserter according to claim 1, wherein the most downstream end of said at least one guide is a transport roller in contact with said one of the folding rollers for forming a nip for engagement of documents to be transported to the stuffing position.

3. An inserter according to claim 1, wherein the document transport path extends between a dead end in the folding assembly and a dead end in stuffing position and turns about a circumferential portion of said one of the folding rollers to substantially reverse its direction.

4. An inserter according to claim 3, further comprising an envelope transport path, said envelope transport path extending from an envelope feeder to the stuffing position, wherein the envelope transport path turns about a circumferential portion of an envelope transport roller to substantially reverse its direction and wherein the envelope transport path joins the document transport path.

* * * * *